United States Patent [19]

Paurat

[11] 4,080,000

[45] Mar. 21, 1978

[54] TUNNELLING MACHINE

[76] Inventor: Friedrich-Wilhelm Paurat, Alte Hunxer Str. 45, Friedrichsfeld, Germany, 4222

[21] Appl. No.: 728,192

[22] Filed: Sep. 30, 1976

[30] Foreign Application Priority Data

Sep. 30, 1975 Germany ..... 2543501

[51] Int. Cl.[2] ..... E21C 25/52; E21C 35/20

[52] U.S. Cl. ..... 299/66; 299/70; 299/71; 299/87

[58] Field of Search ..... 299/57, 71, 70, 66, 299/68, 64, 18, 87; 173/52; 198/316–318

[56] References Cited

U.S. PATENT DOCUMENTS

| | | | |
|---|---|---|---|
| 2,798,711 | 7/1957 | Silver | 299/68 |
| 3,998,493 | 12/1976 | Paurat | 299/71 X |

FOREIGN PATENT DOCUMENTS

| | | | |
|---|---|---|---|
| 1,185,140 | 1/1965 | Germany | 299/57 |
| 2,304,021 | 8/1974 | Germany | 299/70 |
| 1,391,316 | 4/1975 | United Kingdom | 299/64 |

*Primary Examiner*—Ernest R. Purser
*Assistant Examiner*—William F. Pate, III
*Attorney, Agent, or Firm*—Karl F. Ross

[57] ABSTRACT

An excavating and/or tunneling machine having a mobile support unit with suitable endless tracks for advancing the unit. The support unit serves as the base or chassis for an excavating screw, impact devices and excavating boom tools which all are cooperatively brought into operation to cut into material to be mined, excavated and/or tunneled.

8 Claims, 4 Drawing Figures

TUNNELLING MACHINE

FIELD OF THE INVENTION

The present invention relates to an apparatus for mining, tunneling or the like operations. More particularly, my invention relates to an apparatus for mining or tunneling comprising an excavating boom with plural excavating devices and conveying means, both arranged on a mobile support unit having tracked advancing means.

BACKGROUND OF THE INVENTION

Apparatus as briefly defined in the foregoing, may be utilized in the mining of ores or the like and they may be employed in excavating mining of coal.

The excavating head of an excavating boom may comprise a conical tool carrying cutting blades which, on rotation of the tool will perform a cutting or milling action on and into the material that is to be worked on, i.e. the face of the tunnel. In order to increase their longevity, the cutting or milling blades, picks or teeth are customarily equipped with wear resistant hardfacing metal cutting edges.

In known apparatus of this type, the opening that is obtained in the mine face is obtained by milling away material, step-wise, to enlarge an initially obtained opening. Thus, once such an opening has been formed, either by the same machine or by blasting a suitable hole into the material to be worked on, the opening is then enlarged to the desired size, e.g., when a tunneling operation is performed, until the desired cross-section of the tunnel has been reached; or, when mining is carried out, until the full cross-section of the ore body or vein has been excavated. Thus, the material is removed by a milling action. Such an operation is difficult and results in considerable wear of the cutting tools.

With such apparatus, the excavating boom is displaced such that it must gradually eat away the entire cross-section of the area worked on. This means that the machine will then reach its operating limits where the neighboring material is harder, e.g., the transition from coal to bedrock, or, in other words, the wear of the equipment will then become prohibitive for economical operation. Furthermore, the efficiency of the apparatus is lower then harder material is worked on by the apparatus. Then, as well, the progress of the apparatus in the excavation is retarded.

Apparatus has been proposed, generally for use in other fields and of different structure for service for other purposes. In these a support is equipped with heavy duty hydraulic hammers which are capable of producing a high impact. The hammers are, usually, attached by means of booms to scoop excavators. These hammers initially work into the relatively soft coal seam in order to break it up and then work on the stone head wall. Such machinery is considered obsolete for present day requirements in tunneling operations.

I have previously described (U.S. Pat. No. 3,729,056), on a caterpillar of like fulltrack support member, a boom or outrigger which may be rotated by means of a motor as required about a horizontal axis and provided with a milling cutter. This apparatus is further equipped with a conveying means for the transporting of the recovered material.

An additional articulated boom is arranged movably with respect to the support member and has a hydraulically actuated hammer mounted thereon.

In this arrangement the hammer is attached to a base or carriage on the excavating miller boom via a relatively articulated boom and the base may be moved in the longitudinal direction with respect to the apparatus. The hammer is employed when a harder portion or area is to be worked on in an alternating fashion which requires that the milling boom or the hammer boom is actuated, i.e. extended or retracted, in order to bring the hammer into an effective working position with respect to the material to be worked on.

This is, of course, time consuming and thus not too efficient at times. Simultaneous operation of the hammer and the excavating head on the excavating boom at different points of attack cannot be carried out. Thus it is not possible to utilize the excavating head in a lowermost operating position when the hammer has to perform, simultaneously, at a lower power requirement in a head wall area. When the hammer is used, the milling tool is usually tilted excessively and cannot operate effectively.

In summary, the devices according to the prior art do not work with the same efficiency across the entire cross-section of the area to be worked on. That is, in a lower working position or at an upper working position, with respect to the horizontal, the maximum extension of the excavating boom will result in such angles or inclinations of the equipment that do not lend themselves to the most efficient operation of the apparatus.

Of course, devices have been proposed in the past which would mill or excavate at one time the entire cross-sectional area to be obtained while simultaneously also advancing. These are variously equipped with milling tools, rotating chisels or the like. Such machinery has to be brought into direct contact with the material to be worked on under relative high pressure which in turn requires that the devices are properly supported. This becomes time consuming and next to impossible where no suitable counterpressure surfaces are available, i.e. the walls are too soft.

OBJECTS OF THE INVENTION

It is therefore an object of the present invention to provide an improved mining and/or tunneling apparatus.

Another object is the provision of mining and/or tunneling apparatus which avoids the above-mentioned disadvantages of the prior art devices.

Yet another object is to provide a mining and/or tunneling apparatus which can be utilized with good production performance in areas where conventional equipment is relatively inefficient.

SUMMARY OF THE INVENTION

These objectives are attained by an apparatus for mining, excavating and/or tunneling and like operations, according to my invention, which apparatus comprises:

a self-propelled mobile support unit having caterpillar or full-track advancing means and an excavating boom with an excavating miller head mounted thereon;

means for mounting this boom on the support unit in a manner permitting pivoting of the boom about a vertical axis and swinging about a horizontal axis; and on each of the longitudinal sides of the mobile support unit, a forwardly and rearwardly extending carrying arm, the arms supporting a screw type chisel-equipped excavator assembly together with a suitable drive for the provision of motive power to the undercutting screw type excavator.

According to an important feature of the invention, moreover, the self-propelled tracked support unit is provided with a carriage for the boom assembly, i.e. the milling-cutter boom and the means for swinging same about its vertical axis and for swinging it about its horizontal axis, the carriage being shiftable forwardly and rearwardly linearly on the support unit or track chassis. This carriage is guided in a horizontal track or rail arrangement on the mobile support.

When such dual excavation is carried out, i.e. by the action of the excavating boom with its excavating milling head and the screw type undercutting excavator, the forward motion is such that the resulting forces can be countered by the cooperating devices of the apparatus thus obviating rigid countermember means which would require solid counterbearing surfaces or other suitable support means.

When the screw type excavator assembly, in accordance with a further feature of my invention, is reciprocated either together with the carrying arms, or with respect to the carrying arms, along the horizontal axis of the undercutting drums (transverse to the erection of travel of the machine) the ability to operate the apparatus without fixed counterbalancing devices is even more pronounced.

A further feature resides in the provision of a split arrangement of the excavator screw (undercutting-drum) assembly in which the individual sections of the excavator screw (on either side of a vertical longitudinal median plane through the machine) reciprocate in counterphasal fashion, either moving apart or together along their horizontal axes while the screw sections rotate in excavating/tunneling motion about these axes. This arrangement is most advantageous since no special support means are required in view of the relative symmetry of the operational sequence.

To this end, each of the undercutting drums may be provided upon its respective carrying arm and can be swingable therewith about a vertical axis at which the arm is hinged to the support or chassis at a location remote from the undercutting drum. In this case, the angular displacement of the arms is translated into an arcuate displacement of the respective undercutting drums which is practically linear when the angular extent of this displacement is considered under relatively great radial distance of each drum from the arm pivot. Hereinafter, reference has been made to the undercutting drums and it will be apparent that each of these drums can be considered a section of an undercutting drum assembly or an undercutting or excavating worm or screw.

It is also within the scope of my present invention to move the screw sections simultaneously and in the same direction during the horizontal, oscillating movement of the excavator screw assembly.

Whatever the particular configuration, the oscillating motion transverse to the aforementioned median plane permits the number of actual cutters on the drums to be kept to a minimum while the relatively low forward thrust required, permits application of a relatively high pressure in the excavating contact area, i.e. of the rotating cutters against the wall of the tunnel.

This desirable effect is further enhanced by moving the excavator screw assembly up and down either by means of the carrying arms or upon the arms.

Most advantageously, the arms are also swingable about horizontal axes in the region of their vertical-axis pivots, i.e. remote from the undercutting drums, upon the chassis or mobile support so that this vertical movement of the undercutting drums is effected with a large radius of curvature approximating purely vertical movement.

The forward-thrust forces required to bring the excavating screw assembly and its undercutting drums into effective working contact and maintain the working pressure, may be produced, as another feature of my invention, by providing the carrying arms with telescoping means so that they may be hydraulically advanced or retracted. When this is done, the mobile support unit will counter the forces or pressures generated when the excavating boom and the excavating screw assembly are brought into working contact by their respective actuating means, i.e. the carriage for the miller excavating boom and the carrying arms for the excavator screw assembly.

The actual cutting or milling action can be carried out by fixed cutting tools (chisels or picks) arranged on the undercutting drums. I prefer, however, to use cutting rollers which are formed as rolling or rotating chisels or cutting discs spaced about the drums which, as is known, can perform with high efficiency and low wear while, at the same time, maintaining a high, constant pressure against the material that is worked on.

Also, an important feature of my present invention, is the provision of at least one additional auxiliary boom mounted on the carriage for the boom with the milling excavating head referred to earlier. The auxiliary boom has an effective length which exceeds that of the excavating boom. The auxiliary boom or booms furhter carries or carry at least one hydraulically or otherwise actuated reciprocating hammer or similar impact device. In order to effectively control the performance of the hammer or hammers, the auxiliary actuating boom is extensible and retractable in a telescoping manner.

Advantageously, two such hammer booms may be swingably mounted about horizontal axes parallel to the horizontal axis of the milling-cutter boom and can flank the latter, i.e. can be disposed on opposite sides thereof. Preferably the horizontal pivots or the hammer booms are located in the same vertical plane as the horizontal axis of the miller boom but are disposed above the horizontal of the miller boom.

Furthermore, the hammer booms may be swingably mounted about vertical axes on either side of the vertical axis of the miller boom. All of these vertical axes can lie in the aforementioned vertical plane of the horizontal axes and perpendicular to the vertical median plane of the apparatus when all of the booms extend parallel to the latter plane. The booms can be actuated by hydraulic cylinders connected to the forwardly and rearwardly movable slide.

In addition to the hammer or impact device mentioned, therefore, further hammer or hammers or the like may be provided as will be easily appreciated.

Thus, independently of each other but, nevertheless, simultaneously if desired, the several hammers and milling cutters may be operated.

The primary advantages derived by the apparatus according to my invention, may be briefly summarized as follows:

When using the apparatus according to the present invention in working on material having varying degrees of hardness, i,e., hard/soft or hard/hard, an optimum use of the several excavating means can be selected and applied with a high degree of efficiency, so that, as the overall result, the operating costs attributable to the excavating and/or tunneling machine will be low.

The excavating screw assembly performs at low and medium height and upon vertical displacement operations which are difficult to achieve with boom excavators. Since the undercutting excavating screw assembly may perform an oscillating motion in an axial direction, fewer cutting elements are required but the excavator assembly maintains a relatively high contact or working pressure or force on the material that is worked on. Despite this, a separate support or counterbalancing means need not be provided.

When a complex or overlapping oscillating motion is performed by the screw excavating cutters, the pattern achieved is approximately rhomboidal which facilitates fracturing of the material that is worked on.

The milling excavator head on the excavating boom is, in accordance with another feature of my invention, primarily responsible for maintaining the desired cross-section in the upper part of the excavation or tunnel, i.e. on the side walls or the roof portion of the excavation. For this purpose, the excavating head is suitably shaped so that its configuration will lend itself to cooperate most effective in the various portions of the excavating boom.

The hydraulically actuated hammer or hammers, serve to rip away any remaining material that is worked on by the milling excavating means and the undercutting drums.

Since the excavating means works into the material, the hammer or hammers easily breaks away any remaining material along lines of weakness will have been produced by the milling and/or cutting action of the excavating means.

As mentioned earlier, the advantage of the apparatus also resides in the variations provided by actuating one or more of the excavating means, i.e. the screws excavator assembly, milling excavating head on excavating boom and/or hydraulic hammer or hammers which hammers could be actuated either alone or cooperatively together. Thus, with the aid of the apparatus in accordance with my present invention, it is possible to a large extent, to overlap the different operations for desired periods of time.

The cross-section that is to be obtained and maintained as the apparatus progresses on its desired path may be as required, i.e. its particular shape is not limited by the apparatus.

When softer layers of material are traversed by the apparatus, no problems are encountered since the mobile support unit will absorb the force components or resulting pressure thus obviating the need for supporting of the apparatus by the tunnel walls or the like surfaces, for example, by means of removable support arms.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
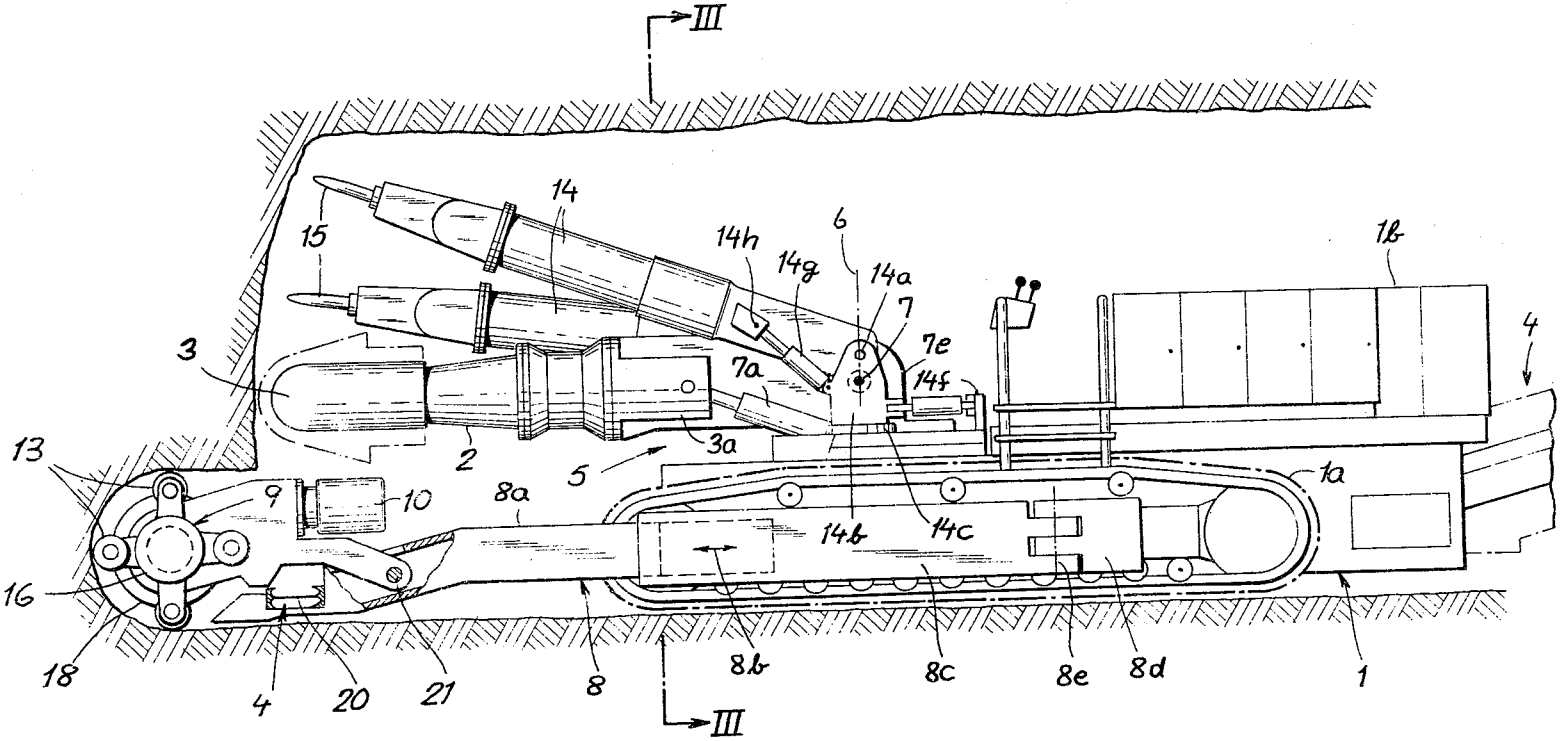
FIG. 1 is a side elevation of an apparatus according to the present invention shown in operating position.
Figure 2:
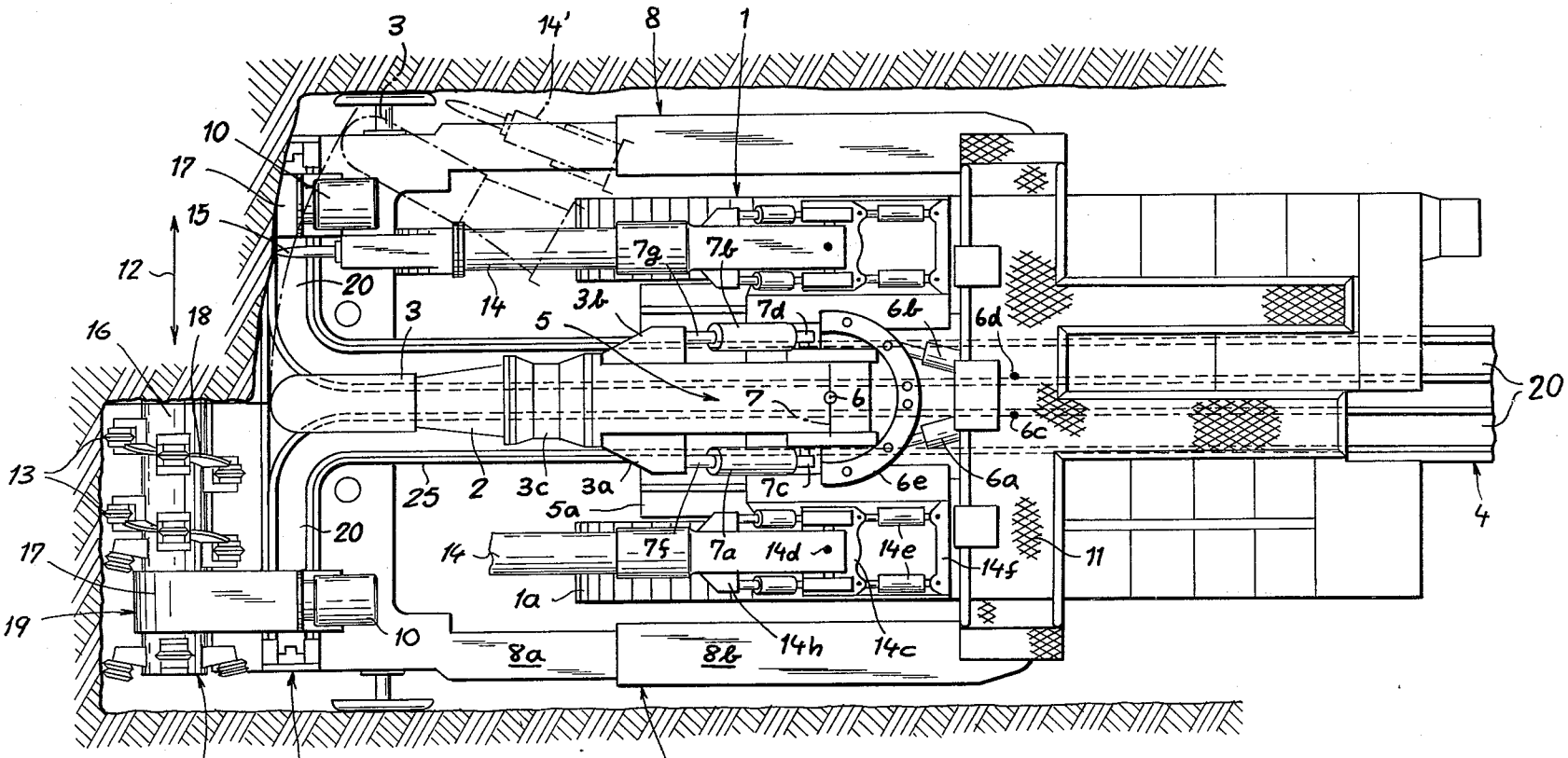
FIG. 2 is a plan view of the apparatus shown in FIG. 1 also indicating the operation of the apparatus.

As will best be seen in FIGS. 1 and 2, a mobile support unit 1 is provided having caterpillar or similar tracks 1*a* for advancing the apparatus, the tracks being driven by an engine in housing 1*b*. A boom 2 having a milling excavating head 3 (U.S. Pat. No. 3,729,056) is rotatable about a vertical axis 6 on a carriage 5 shiftable longitudinally on a guide 5*a* on support unit 1. In addition, the boom can be pivoted about horizontal axis 7 shown in FIGS. 1 and 2. The boom 2 can be moved in the longitudinal direction by the carrier 5.

The vertical movement of the boom 2, about the axis 7, is effected by a pair of hydraulic cylinders 7*a* and 7*b* which are pivotally mounted at 7*c* and 7*d* for swinging movement about respective horizontal axes upon a trunnion 7*e* forming the axis 7. The piston rods 7*f* and 7*g*, respectively, are articulated to a pair of lugs 3*a* and 3*b* projecting laterally from the boom 2. The head 3 is rotated by a hydraulic motor diagrammatically represented at 3*c* on the boom 2.

A further pair of hydraulic cylinders 6*a* and 6*b*, swingable about respective vertical axes 6*c* and 6*d* (shown diagrammatically in FIG. 2) on the carriage 5 and are pivotally connected to a turntable 6*e* carrying the trunnion 7*e* and displaceable about the axis 6. Thus the cylinders 6*a* and 6*b* can be hydraulically actuated to swing the boom 2 about this vertical axis 6.

A service platform for the control of the apparatus is designated 11. Other conventional sevice facilities such as hydraulic power, control and like devices can be arranged on mobile support unit 1 but are not described in detail.

Carrying arms 8 are secured to the support unit 1 and carry on their free ends in suitable journal means 17, respective cutting drums 9*a*, 9*b* of an excavator assembly generally designated by numeral 9. Each drum of the excavator assembly 9 comprises a hollow shaft 16, best seen in FIG. 2, which serves as the best support for a flight or helix 18. Mounted on this flight or helix are brackets for rotating cutters 13. Further cutters 13 are uniformly spaced arranged on the hollow shaft 16 and particularly at the ends, respectively, as will best be seen by referring to FIG. 2. The drums 9*a* and 9*b* of the excavator assembly can be rotated by respective electric drives 10, not shown in detail, and bevel-gear transmissions 19 also serving for journalling of the excavator assembly.

Carrier 5, described above, also serves to support further auxiliary booms 14 which have lengths such that these auxiliary booms can work in the area above that worked on by boom 2 with its excavating head 3. The auxiliary booms 14 are telescoping extensible or retractable and are equipped at their free ends with hydraulically actuated hammers or the like, designated 15 (see the aformentioned patent). These may be controled by means of hydraulic cylinders horizontally as well as vertically.

As can also be seen from FIGS. 1 and 2, each of the booms 14 is swingable about the respective horizontal axis 14*a* on a pair of trunnions 14*b* carried by respective turntables 14*c*. The turntables are swingable about vertical axes 14*d* by hydraulic cylinders 14*e* hinged to uprights 14*f* on the slide 5. The trunnions 14*b* also pivotally carrying pairs of hydraulic cylinders 14g whose piston rods are hinged to lugs 14h extending laterally from the booms 14. Thus the cylinders 14g serve to raise and lower the tools 15 at the ends of the booms 14 while cylinders 14e permit independent swinging movement of these booms about vertical axes parallel to the axis 6. The milling head 3 can thus be swung into the dot-dash line position illustrated in FIG. 2 while one or both of the booms 14 may be swung in the same sense or in the opposite sense (see dot-dash position 14' illustrated in FIG. 2).

Figure 3:
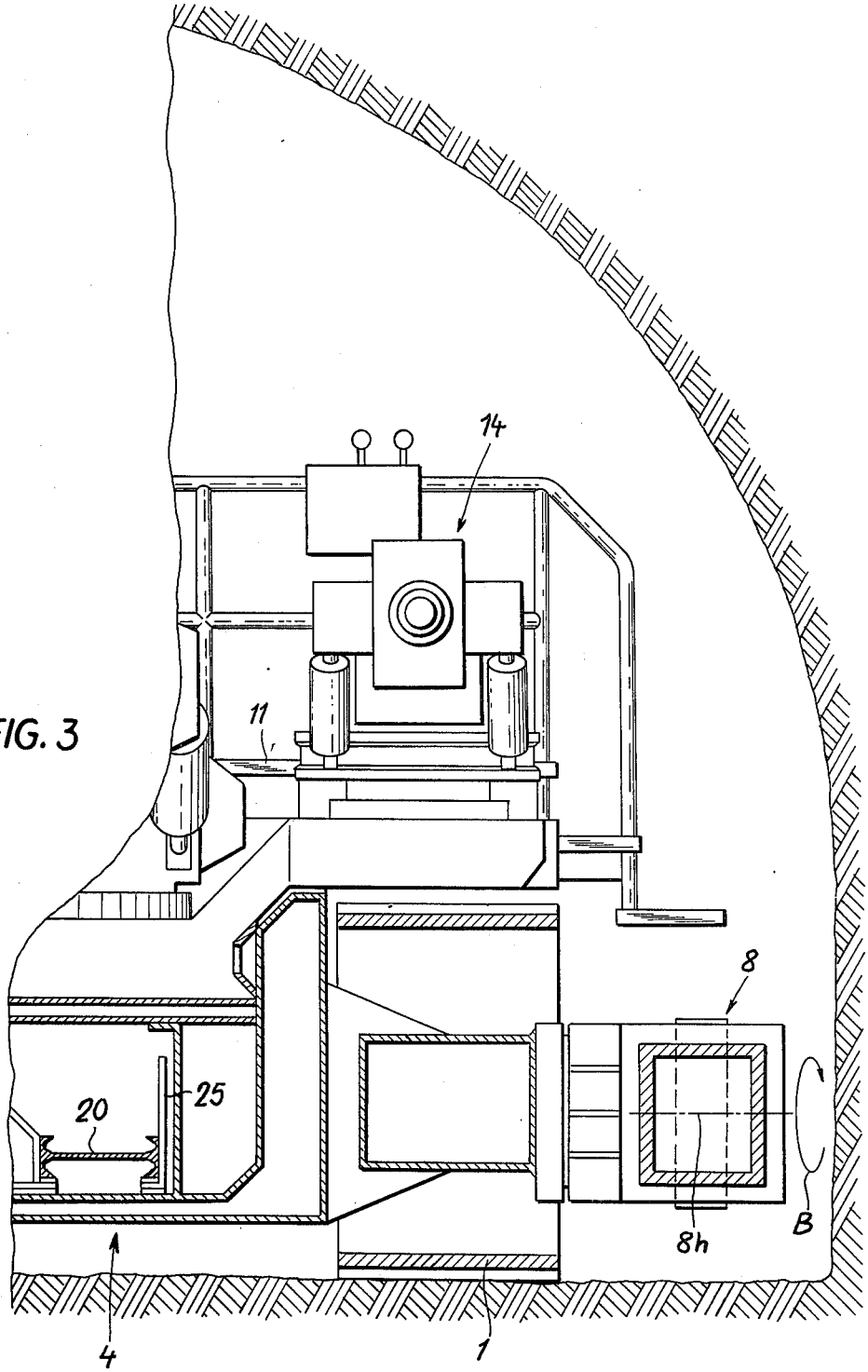
FIG. 3 is a cross-section along arrows III - III of FIG. 1.

To effect the horizontal oscillating movement of the excavating drums 9a and 9b, the latter can each be mounted on the respective one of the arms 8. The arms 8 can be seen to have an inner member 8a which is shiftable in the direction of arrow 8b (telescopingly) by hydraulic pressurization behind this arm of the cylinder formed by the outer arm 8c. The latter can be swingably mounted in a laterally extending support 8d of the chassis 1 for movement about a vertical axis as represented at 8e in FIG. 1. Thus, in actuality, the opposing outward and inward movements of the two drums is somewhat arcuate rather than linear as represented by the arrows 9a' and 9b'. When pivoting in the horizontal plane is not desirable, the supports 8a themselves may be mounted for angular displacement as represented by the arrow B in FIG. 3, for rotation about the horizontal axis 8h. Hydraulic means (not shown) is also provided to effect the displacement of the arms 8.

Of the pieces of equipment thus far described, excavator assembly 9, boom 2 with excavating head 3 and/or hammers 15 and carrier 5 are independently actuated of each other but may be actuated simultaneously.

The particular operational features of the apparatus of my invention can best be understood with reference to FIG. 2.

Figure 2A:
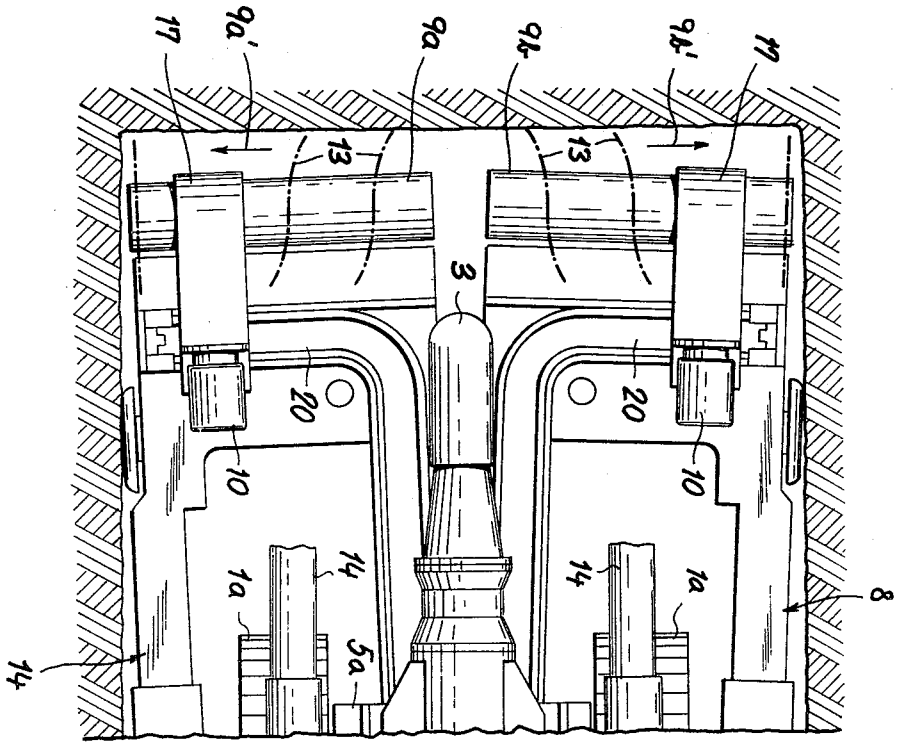
FIG. 2A is another plan view of a portion of the apparatus partly broken away.

Part of the excavator assembly of FIG. 2 is covered by the material to be mined. Arrows 12 indicate the directions in which the milling action is carried out. As will be easily appreciated, this can be achieved by rotation of shaft 16 with its rotating cutters 13 and/or it may be achieved by an oscillation counterphasal (opposite) movement of carrying arms 8 (arrows 9a' and 9b' in FIG. 2A).

The drum of the excavator assembly can be rotated in the same direction or oppositely with respect to each other.

As can best be seen in FIG. 1 the drum 9a and 9b of the excavator assembly 9 may be pivoted about a horizontal axis 21 to permit up and down movement.

In order to transmit sufficient excavating pressure to the excavator assembly, carrying arms 8 are telescoping and can be advanced by hydraulic means simply by forward movement of the mobile support unit.

The excavator assembly is equipped with rotating cutters 13 which may be hardmetal faced cutters which can achieve a high degree of efficiency despite high actuating pressures and, at the same time, show little wear.

After being excavated or loosened, the material is conveyed into the receiving area, generally to the rear of the apparatus by conveyors 4. The conveyors are also integrally formed with the mobile unit 1 or can be attached to it. As such, the conveyors should be extensible and closely cooperating with the movement of the respective excavating drums 9a, 9b so that when the excavator assembly is advanced or moved backward, the conveying means 4 will perform a corresponding motion. With particular reference to FIG. 2, the conveying means 4 comprises suitable skirts means 25 and a set of conveyor belts 20.

I claim:

1. A tunnelling machine comprising:

a tracked support having a longitudinal axis and displaceable in the direction of said axis with a forward end;

a carriage displaceable on said support parallel to said axis;

a boom swingably mounted on said support for pivotal movement about a vertical axis and for pivotal movement about a horizontal axis;

a milling tool on said boom rotatable about another axis;

a pair of arms flanking said support and mounted at one extremity of each of said arms on said support, said arms extending beyond said end of said support;

a rotating undercutting excavator rotatable about at least one horizontal axis on said arms at said end; and means for displacing said excavator upwardly and downwardly at said end of said support, said means for displacing said excavator upwardly and downwardly including a pivot for each of said arms at said one extremity enabling the swinging movement thereof about a vertical axis.

2. A tunnelling machine comprising:

a tracked support having a longitudinal axis and displaceable in the direction of said axis with a forward end;

a carriage displaceable on said support parallel to said axis;

a boom swingably mounted on said support for pivotal movement about a vertical axis and for pivotal movement about a horizontal axis;

a milling tool on said boom rotatable about another axis;

a pair of arms flanking said support and mounted at one extremity of each of said arms on said support, said arms extending beyond said end of said support;

a rotating undercutting excavator rotatable about at least one horizontal axis on said arms at said end; and means for displacing said excavator upwardly and downwardly at said end of said support, said means for displacing said excavator upwardly and downwardly including a pivot formed on said arms proximal to said end for swinging said excavator about a horizontal axis parallel to the axis of rotation of said excavator.

3. A tunnelling machine comprising:

a tracked support having a longitudinal axis and displaceable in the direction of said axis with a forward end;

a carriage displaceable on said support parallel to said axis;

a boom swingably mounted on said support for pivotal movement about a vertical axis and for pivotal movement about a horizontal axis;

a milling tool on said boom rotatable about another axis;

a pair of arms flanking said support and mounted at one extremity of each of said arms on said support, said arms extending beyond said end of said support;

a rotating undercutting excavator rotatable about at least one horizontal axis on said arms at said end;

means for escillating said excavator along its axis of rotation, said excavator comprising a pair of symmetrically disposed undercutting drums each mounted on a respective one of said arms; and means for counterphasally displacing said drums toward and away from one another substantially along respective axes of rotation of said drum, said drums being displaceable together along their respective axes of rotation.

4. The machine defined in claim 3 wherein each of said arms comprises at least two telescoping parts relatively displaceable upon fluid pressurization.

5. The machine defined in claim 3 wherein said excavator comprises a rotating support drum formed with a plurality of rotating cutters spaced around said drum.

6. The machine defined in claim 3, further comprising at least one further boom mounted on said carriage for pivotal movement about a vertical axis and about a horizontal axis, said further boom being provided with at least one hydraulic hammer adapted to project beyond said tool.

7. The machine defined in claim 6 wherein said further boom is telescopingly extensible.

8. The machine defined in claim 6 wherein said boom, said tool, said hammer and said excavator are simultaneously and independently actuatable.

* * * * *